United States Patent [19]

Ruscigno

[11] Patent Number: 4,552,132

[45] Date of Patent: Nov. 12, 1985

[54] PULSATING HYDROTHERAPY SYSTEM

[75] Inventor: Harry G. Ruscigno, Orange, Calif.

[73] Assignee: Advanced Medical Products, Inc., Sherman Oaks, Calif.

[21] Appl. No.: 650,690

[22] Filed: Sep. 17, 1984

[51] Int. Cl.[4] ..... A61H 9/00

[52] U.S. Cl. ..... 128/38; 128/40

[58] Field of Search ..... 128/33, 44, 47, 66, 128/DIG. 15, 38, 39, 40, 24.2, 24 R

[56] References Cited

U.S. PATENT DOCUMENTS

| | | | |
|---|---|---|---|
| 2,272,481 | 2/1942 | Rinker | 128/66 |
| 2,379,497 | 7/1945 | Sellmeyer | 128/24 R |
| 2,531,074 | 11/1950 | Miller | 128/38 |
| 2,971,471 | 2/1961 | Huebschman | 128/38 |
| 3,548,809 | 12/1970 | Conti | 128/24 R |
| 3,862,629 | 1/1975 | Rotta | 128/24 R |
| 4,453,538 | 6/1984 | Whitney | 128/24 R |

FOREIGN PATENT DOCUMENTS

| | | | |
|---|---|---|---|
| 1464774 | 11/1966 | France | 128/40 |

*Primary Examiner*—Clyde I. Coughenour
*Attorney, Agent, or Firm*—Keith D. Beecher

[57] ABSTRACT

A pulsating hydrotherapy system for the effective treatment of musculo-skeletal disorders. The system includes a control unit which produces a pulsating water flow, a cuff designed to fit over the affected area of the patient and including tubular coils, and tubing to carry the pulsating water from the control unit to the coils of the cuff. The cuff is constructed of layers of polyurethane foam to fit comfortably over the patient's neck, leg or arm, or to fit the patient's back. The coils in the cuff are constructed so that the pulsating water flows in one direction only and parallel to the flow of blood. As the pulsating water wave travels through the coils in the cuff, a peristaltic action is transmitted to the circulation below. To maximize the pulsating water wave amplitude, two independent sets of coils are used in the cuff thus shortening the distance the wave must be propagated. The control unit applies the pulsating water wave first to one set of coils and then to the other.

7 Claims, 7 Drawing Figures

PULSATING HYDROTHERAPY SYSTEM

BACKGROUND OF THE INVENTION

The pulsating hydrotherapy system of the invention is of the same general type as described in Grossan U.S. Pat. No. 3,993,053, and it incorporates certain improvements over the system described in the patent. Like the system described in the patent, the system of the present invention makes use of heat and precisely placed peristaltic waves to promote local circulation and to induce muscle relaxation. The system is entirely closed, and water never touches the patient. Also, the coils in the cuff are covered by an appropriate fabric cover, so that they do not contact the skin of the patient, so that there is no danger of burning.

The pulsating hydrotherapy system of the invention utilizes and improves upon the body's own method for promoting circulation in the venous and lymphatic systems, this being achieved by a massaging action on the overlaying skeletal muscle. The massaging action on the skeletal muscle, produced by a warm, temperature regulated, peristaltic pulsating water wave, moves fluids along the venous and lymphatic channels, thereby promoting venous and lymphatic return in the same manner as realized by natural activities such as walking.

However, unlike walking or other forms of physical therapy, the peristaltic wave is designed to travel in the system of the invention in the same direction as normal venous lymphatic flow, namely, towards the heart. Normal muscle activity and such forms of physical therapy as whirlpool or electric stimulation result in the production of a nondirectional force which only incidentally promotes proper flow. Furthermore, the cuff of the system of the invention is capable of applying the pulsating water wave proximally to the site of the injury, so that fluids are drawn away from the injury instead of through the injured area. This minimizes the chance of re-damaging the local circulation.

In addition to the direct effect the system of the invention has on promoting local venous and lymphatic circulation, the system also has an indirect effect of promoting arterial circulation. By drawing fluid along in the venous system, a decrease in local venous pressure occurs, increasing the arterio-venous gradient and thus promoting arterial blood flow.

In those case where circulation is impeded by muscle spasm, the system of the invention is capable of improving circulation by relaxing the spasm and thereby reducing local resistance in the venous system.

By treating the injured area with the system of the invention, the operator can apply a wave of precise temperature, frequency and amplitude to the injured area, the application of which moves accumulated fluids out of an edematous area, promotes local circulation and reduces muscle spasm. Such actions aid in reducing the size of the edematous area, reducing pain due to tissue anoxia and promoting the healing of the musculoskeletal injury.

It is accordingly an objective of the present invention to provide a pulsating hydrotherapy system which is safe and effective, which is comfortable for the patient, and which is easy to operate without the requirement for any specialized skills on the part of the operator.

Another objective of the invention is to provide an improved pulsating hydrotherapy system which produces a warm, gentle, pulsating wave designed to reduce edema, increase venous and lymphatic return, and relax muscle spasms.

DETAILED DESCRIPTION OF THE ILLUSTRATED EMBODIMENT

Figure 1:
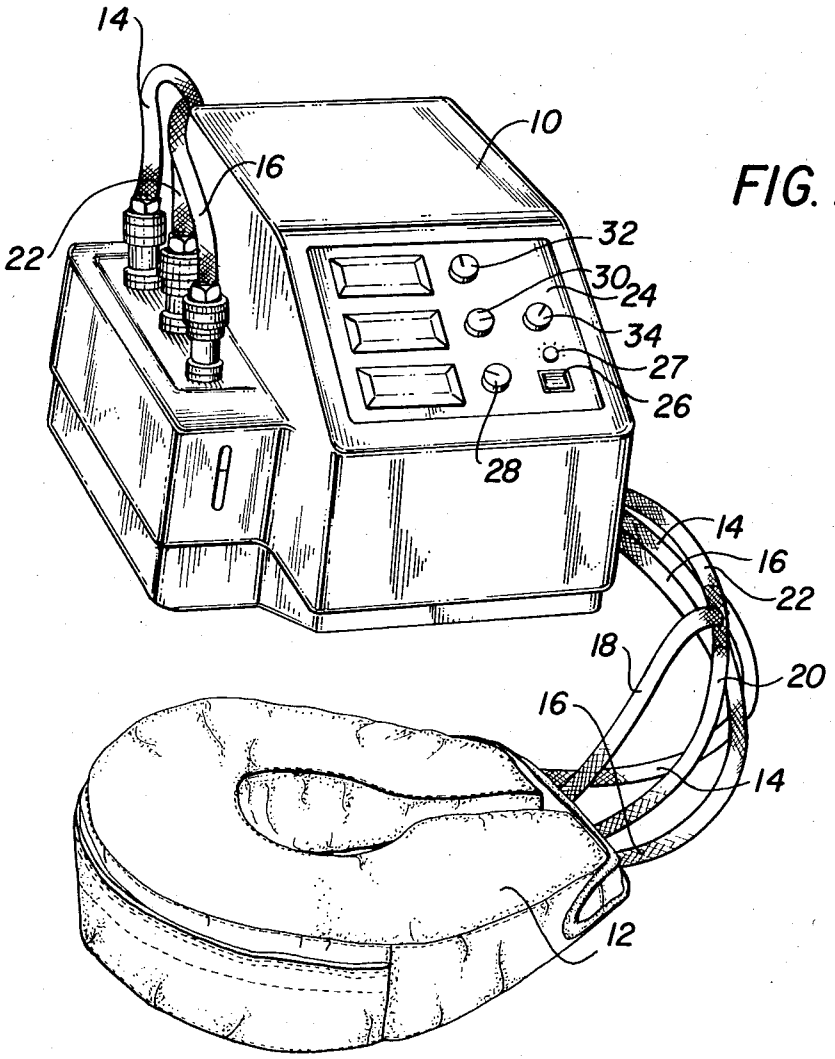
FIG. 1 is a perspective view of the system of the invention in one of its embodiments, showing a control unit coupled through appropriate tubing to a cuff which is designed to be fitted over the injured area of a patient.

The system shown in FIG. 1 includes a control unit 10 and a flexible cuff 12 of a generally horseshoe configuration. The cuff 12, as will be described, includes two independent sets of tubular coils, and the control unit is coupled to one set through a tubular flexible lead 14 and to the other set of coils through a flexible tubular lead 16. The flexible tubular return leads 18 and 20 from the coils are joined together and coupled to a common flexible tubular return lead 22.

The control unit 10 includes a control panel 24 which, in turn, supports a switch 26 which is used to turn on an internal heater, as indicating lamp 27 which is illuminated when the heater is energized, and a series of control dials 28, 30, 32 and 34. Control dial 30 controls the pulse amplitude of the water pulses fed to the coils in the cuff 12, dial 28 controls the frequency of the pulses, dial 32 controls the temperature of the water pulses, and dial 34 sets a timer to turn off the control unit automatically after a preset time interval.

The control unit also includes a water reservoir, a heater, a pump, a motor for driving the pump, and a motor driven valve for converting the continuous pressurized output water stream from the pump into a pulsating wave. The valve may be of the type described in Copending Application Ser. No. 516,996, filed July 25, 1983, although any other appropriate known type of valve may be used. The heater serves to heat the water forming the pressurized stream to a particular temperature as set by dial 32. The speed of the pump and valve are controlled by dial 28 which determines the frequency of the pulsating water stream in the tubular leads 18 and 20, and the water pressure is controlled by dial 30 which controls the amplitude of the pulses.

The valve within the control unit controls the flow of water from the control unit so that a pulsating water wave is introduced to the tubular lead 14 and through the first set of coils in cuff 12 and back through the common tubular return lead 22, and the pulsating water wave is also directed through tubular lead 16 through the other set of coils in the cuff 12, and back through the common tubular lead 22. The valve within the control unit operates in such a manner, as described in the Copending Application, that the two pulsating pressurized water streams are directed in an alternate manner to the two sets of coils in the cuff 12.

As described above, the control panel 24 of the control unit contains dials for setting wave frequency, wave amplitude, wave water temperature and the duration of the treatment. In addition, there are digital displays 40 that provide accurate read-outs of actual temperature and of the selected amplitude and frequency of the water waves. Thus, precision is achieved by creating the therapeutic water waves, slow to rapid pulse, low to high amplitude and a range of temperature, all of which permits the system to be used in a wide variety of applications.

Figure 2:
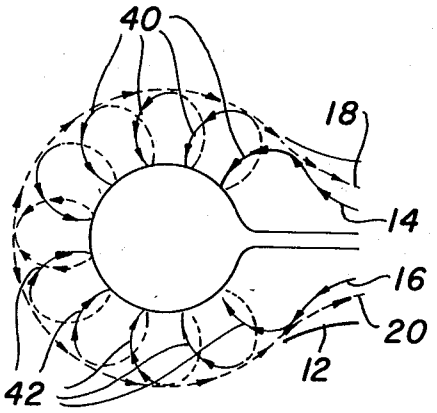
FIG. 2 is a schematic representation showing two distinct set of tubular coils within the cuff.

As shown in FIG. 2, the cuff 12 has a first set of tubular coils 40 which connect to the tubular lead 14, and a second set of tubular coils 42 which connect to the tubular lead 16. The return from the first set of coils is connected to tubular lead 18 and the return from the second set of coils is connected to tubular lead 20.

Figure 3:
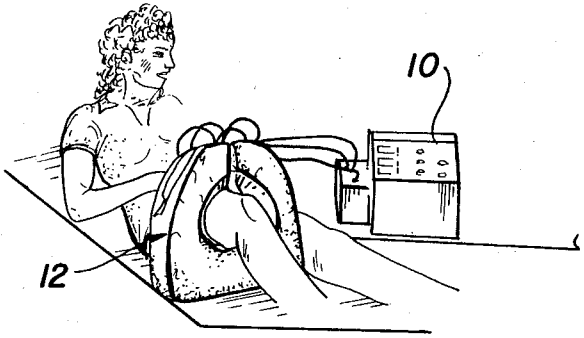
FIG. 3 shows the system of FIG. 1 with the cuff fitted over the thigh of a patient.
Figure 4:
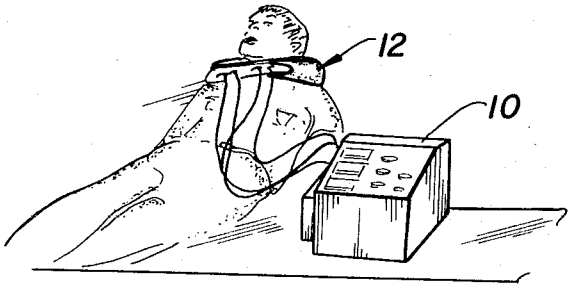
FIG. 4 shows the system of FIG. 1 with the cuff fitted over the neck of a patient.
Figure 5:
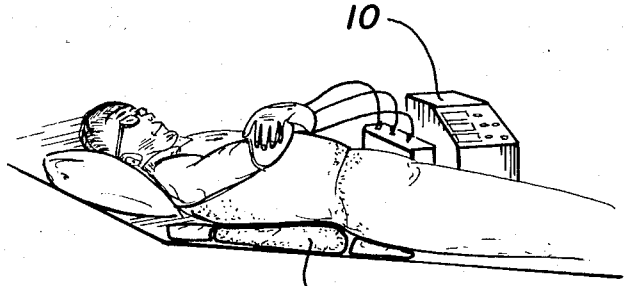
FIG. 5 shows the system with a special attachment for treating the back of a patient.

As shown in FIG. 3, the cuff 12 may be comfortably fitted over the limbs, such as the thigh of a patient. In like manner, the cuff can be fitted over the patient's arm. Likewise, and as shown in FIG. 4, the cuff may be fitted to the cervix or neck of the patient. In FIG. 5, a special pad 46 is provided which comfortably fits under the back of the patient, and which also has two sets of tubular coils similar to the cuff of FIG. 2.

Figure 6:
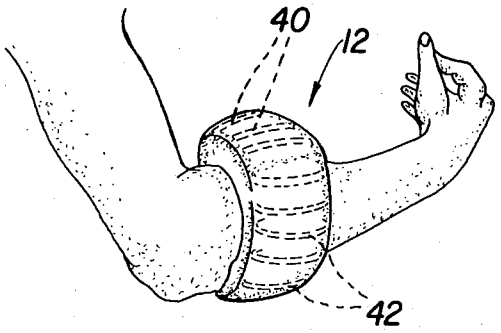
FIG. 6 is a somewhat schematic representation showing the cuff of the system on the arm of a patient, and representing the direction of the massaging action produced by the cuff.

The cuff 12 is shown schematically in FIG. 6 as fitted over the arm of the patient. When the cuff is so fitted, the system has several effects on the venous and lymphatic systems, all of which promote local circulation. First, the peristaltic waves of the cuff produce a direct action on superficial vessels of the venous and lymphatic systems, as shown in FIG. 6. This action is unidirectional, always moving the venous and lymph fluids towards the heart.

Second, the rhythmic waves of the system produces waves in the underlying muscles. These muscle waves assist in moving fluids in the deeper vessels of the venous and lymphatic systems in much the same way as muscle contractions do during exercise.

Finally, by moving venous fluid towards the heart, the system of the invention reduces the local venous pressure and thereby increases the local arterial venous gradient. This increases the flow in local microcirculation. Such effects on the microcirculation reduce tissue anoxia and promote healing.

Figure 7:
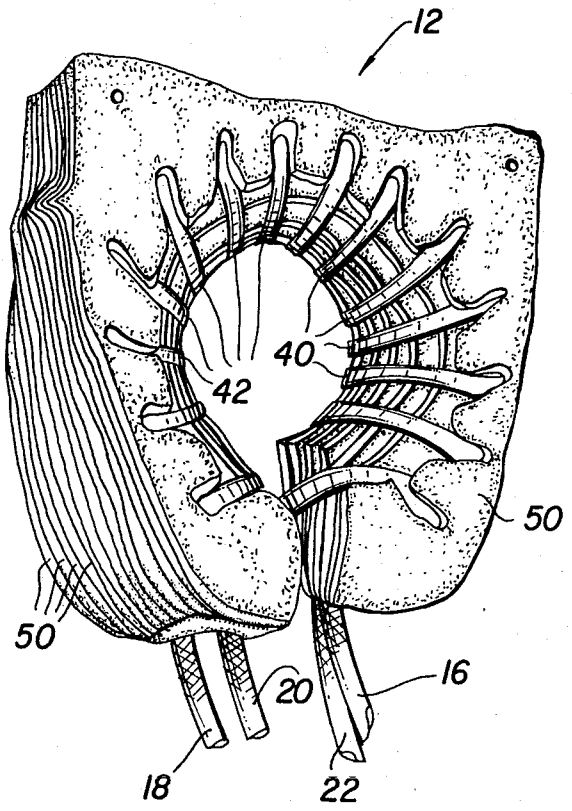
FIG. 7 is a view of the cuff of FIG. 1 with the protective fabric cover removed to reveal the inner tubular coils of the cuff and layers of polyurethane foam which serve as a support for the coil.

FIG. 7 is a representation of the cuff of FIG. 1 with the fabric protective cover removed. As shown in FIG. 7, the cuff is made up of layers 50 of polyurethane foam, or other appropriate material so that the cuff may be worn comfortably by the patient. The tubular coils 40 and 42 are wound around the layers, as shown, and are supported by the layers, and also hold the layers together. The flexible tubular leads 16, 18, 20 and 22 extend into the polyurethane foam layers, and are connected to the coils 40 and 42, so as to provide the pulsating pressurized water flow to the coils on the alternating basis described above.

The invention provides, therefore, an improved pulsating hydrotherapy system for the effective treatment of musculo-skeletal disorders such as localized edema, decreased circulation, muscle pain due to tissue anoxia and muscle strains and sprains. The system is advantageous in that it includes a cuff which is constructed of a foam material to be worn comfortably by the patient, and which includes two sets of coils so that the pulsating water may pass through the cuff without undue attenuation. Also, the cuff is covered by a soft fabric material which covers the coils within the cuff so that there is no direct contact between the coils and the skin of the patient.

It will be appreciated that while a particular embodiment of the invention has been shown and described, modifications may be made, and it is intended in the claims to cover all modifications which come within the true spirit and scope of the invention.

What is claimed is:

1. A pulsating hydrotherapy system for enhancing the flow of venous blood and lymphatic fluid comprising: a flexible cuff of a generally horseshoe configuration to be fitted over the limbs or cervix of a patient formed of a foam material; first and second tubular coils looped around the cuff, with the first coil positioned at one side of the cuff and with the other coil positioned at the other side of the cuff, the coils being positioned each to have a set of tubular segments adjacent the inner surface of the cuff in spaced parallel relationship parallel to the flow of venous blood of the patient; a source of two streams of pulsating fluid; and tubular leads coupling the source to the coils to introduce a first stream of pulsating fluid to one of the coils and a second stream of pulsating fluid to the other and to return both streams of pulsating fluid from the coils to the source, so that the pulsating fluid flows in a cardiocipetal direction only in said tubular segments.

2. The system defined in claim 1, in which said tubular leads are formed of a flexible material.

3. The system defined in claim 1, and which includes a flexible cover enclosing the cuff and serving to insulate the skin of the patient from said tubular segments.

4. The system defined in claim 3, in which the flexible cover is formed of a fabric material.

5. The system defined in claim 1, in which said source introduces the first and second streams of pulsating fluid to the coils in an alternating manner.

6. The system defined in claim 1, in which the foam material forming the cuff comprises a multiplicity of flat members stacked on top of one another and held in place by the coils.

7. The system defined in claim 6, in which said foam material is a polyurethane foam, or the like.

* * * * *